United States Patent [19]

Castagna

[11] 4,331,841

[45] May 25, 1982

[54] GRILLE COVERED SPEAKER MOUNTING ASSEMBLY FOR AUTOMOBILE DECKS AND THE LIKE

[75] Inventor: John F. Castagna, Brooklyn, N.Y.

[73] Assignee: Sparkomaric Corporation, Milford, Pa.

[21] Appl. No.: 174,191

[22] Filed: Jul. 30, 1980

[51] Int. Cl.[3] ..... H04R 1/02

[52] U.S. Cl. ..... 179/146 E; 179/1 VE; 179/115.5 PS

[58] Field of Search ..... 179/1 VE, 146 R, 146 E, 179/178, 184

[56] References Cited

U.S. PATENT DOCUMENTS 3,938,618 2/1976 Ambrudso, Sr. ..... 181/155

4,032,725 6/1977 McGee ..... 179/146 R

*Primary Examiner*—George G. Stellar

*Attorney, Agent, or Firm*—Mason, Fenwick & Lawrence

[57] ABSTRACT

A speaker assembly for installation in automobiles as in automobile rear decks and like installations in automobiles, including a main speaker section having a speaker basket frame provided with mounting ears for receiving mounting studs to fix the speaker basket frame against the underside of a deck in the automobile. The main speaker section includes a woofer speaker unit and a bridge member supported from the basket frame carrying a tweeter speaker unit. A grille panel of unitary plastic material has a set, usually four, of spaced preformed sockets to receive upper end portions of threaded mounting studs to be screwed by hand pressure, and then with pliers or the like into the holes, after which a flat spring nut is screwed down on each threaded stud, or one-piece shouldered threaded mounting studs may be used without the spring nut. The studs and grille are positioned on the deck with the studs extending down through the mounting holes in the automobile rear deck, the main speaker section is positioned onto the studs below the deck, and speed nuts are screwed onto the studs.

14 Claims, 8 Drawing Figures

Fig-1
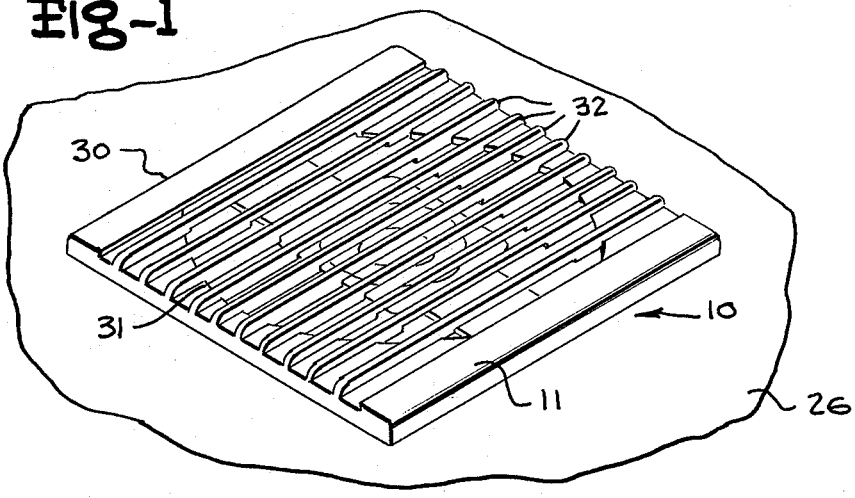
Fig-8
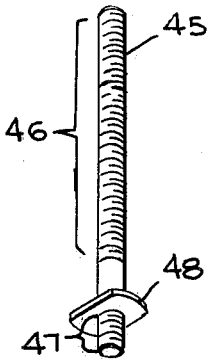
Fig-7
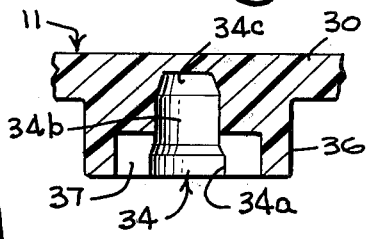
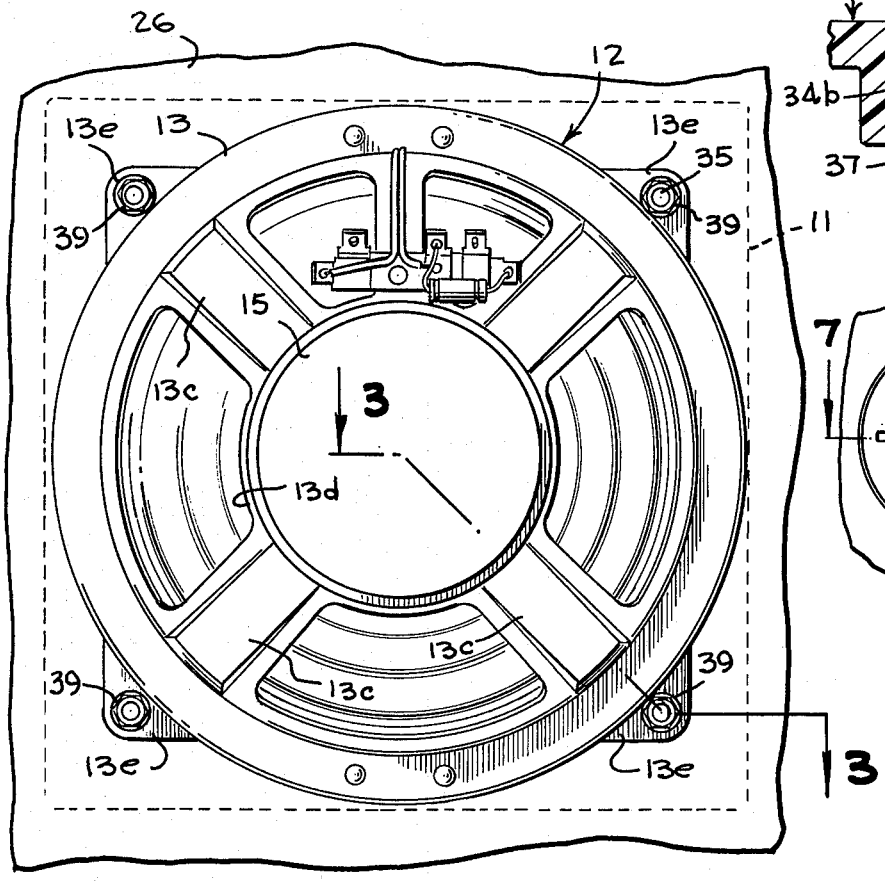
Fig-2
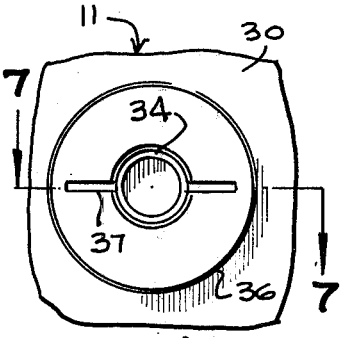
Fig-6

Fig. 3
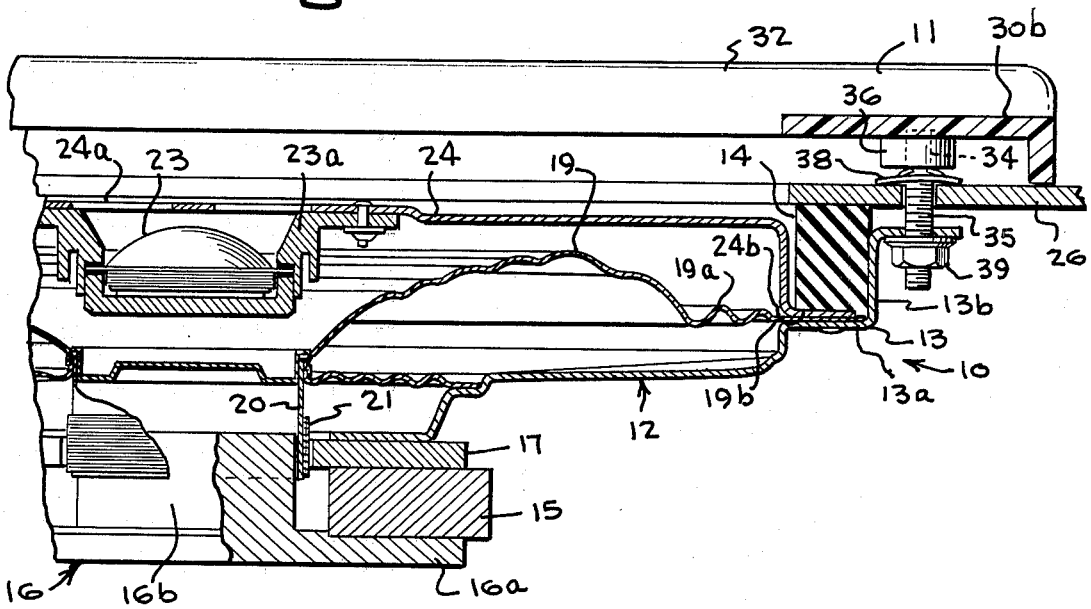
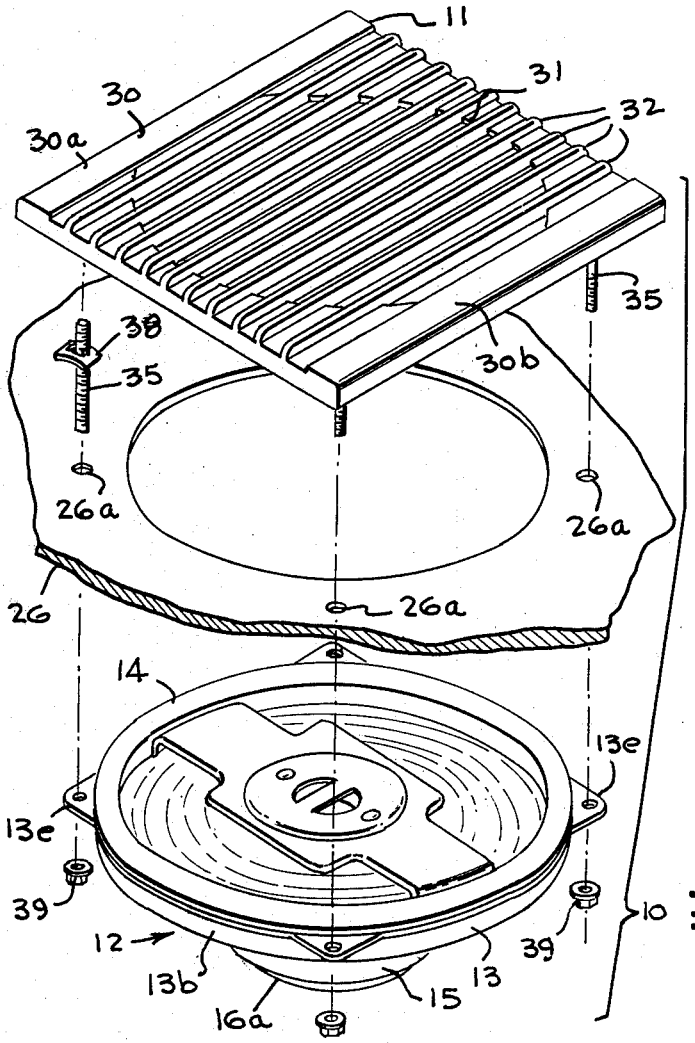
Fig. 4
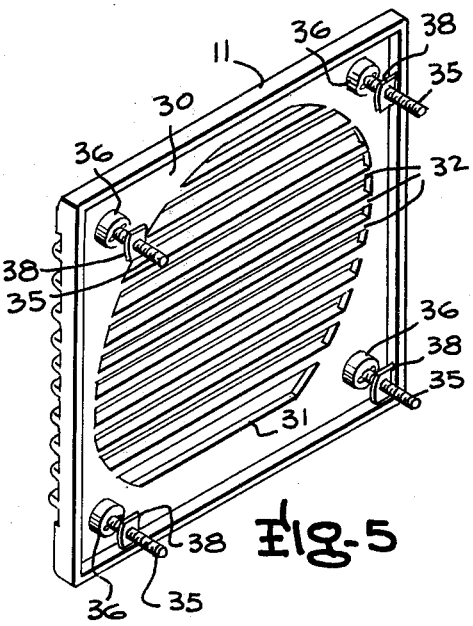
Fig. 5

GRILLE COVERED SPEAKER MOUNTING ASSEMBLY FOR AUTOMOBILE DECKS AND THE LIKE

BACKGROUND AND OBJECTS OF THE INVENTION

The present invention relates in general to deck mounted automobile type speakers for stereo sound reproducing systems and the like, and more particularly to two-way stereo speaker structures for automobile rear decks and the like capable of providing tweeter and midrange sound reproducers and mounting structure conveniently adaptable to mounting such speakers on the decks of such automobiles and the like.

Conventional electrodynamic speakers customarily comprise a cone of semi-rigid material which is secured at its outer edge to a rigid frame. In many instances, the cone is corrugated near the outer edge to provide a degree of flexibility in this region of the cone so as to permit the cone to move as a piston under the influence of a voice coil which is secured to the cone at its apex. The voice coil is located within a cylindrical gap of a magnet which provides a substantially constant magnetic field across the gap. The magnetic field set up by the audio frequency currents supplied to the voice coil interacts with the constant field of the magnet with the result that physical forces are applied to the voice coil which tend to move the voice coil and the attached cone in a direction parallel to the axis of the cone.

It is normal in the mounting structure of conventional deck mounted speakers to provide a set of four threaded bushings fixed in the grille of such speaker units, for example by molding them in the grille or installing them by sonic welding techniques, to receive end portions of threaded mounting studs which extend through mounting holes in the automobile rear deck adjacent the hole provided for the speaker. After the threaded studs are threaded into the bushings fixed in the grille, the grille is positioned over the speaker hole in the deck and the threaded mounting studs extended downwardly through the mounting stud holes in the deck and the holes in mounting formations on the speaker basket to secure the basket or main ring portion of the speaker by the mounting studs and nuts applied thereon onto the deck to mount the basket or mounting frame, the cone, the centering spider, the voice coil support and the voice coil, as a unit, on the stationary rear deck.

The necessity of providing the separate bushings in the grille in some manner, to receive the threaded mounted studs, has been a source of problems and introduces a cost factor which it would be desirable to reduce in some manner. Usually the threaded bushings are inserted into the grille as a post-operation after molding of the grille. To assure that the threaded bushings hold in the plastic material of the grille, the bushing is usually pushed in using "sonic" welding. The bushings have to be placed in the grille one at a time, which is costly. Another conventional method of placing such bushings in the grille is to load a mold for four bushings and then mold the plastic grille around the bushings. This causes problems because the bushings are not firmly held in the mold during the molding process and can fall out of position and damage the mold.

An object of the present invention is the provision of a novel speaker mounting system to facilitate mounting of the speaker by fasteners depending from the grille through the deck and through holes in the speaker basket to receive threaded mounting nuts, which reduces the cost associated with deck mounting systems wherein threaded bushings must be incorporated in the grille.

Another object of the present invention is the provision of a novel speaker mounting system including a speaker grille to be supported over a hole in a horizontal deck, wherein threaded mounting studs are threaded into unthreaded holes molded in the plastic grille and flat spring nuts are applied onto the studs to positions abutting the grille, or preformed thin shoulders are provided on the mounting studs, to bear against the top surface of the deck when installed and support the weight of the speaker to be carried by the mounting studs underneath the deck.

Other objects, advantages and capabilities of the present invention will become apparent from the following detailed description, taken in conjunction with the accompanying drawings illustrating an embodiment of the invention incorporating my novel thin speaker design, although it will be understood that the mounting system of the present invention is equally applicable to conventional deep speakers.

BRIEF DESCRIPTION OF THE FIGURES

FIG. 1 is a top perspective view of the deck mount speaker and grille assembly mounted on an automobile rear deck;

FIG. 2 is a bottom plan view of the speaker portion mounted on the deck;

FIG. 3 is a fragmentary section view taken along line 3—3 of FIG. 2;

FIG. 4 is an exploded perspective view of the assembly;

FIG. 5 is a bottom perspective view of the grille;

FIG.6 is a fragmentary bottom plan view of one of the molded stud hole portions of the grille, to enlarged scale;

FIG. 7 is a section view, through the molded stud portion, taken along the line 7—7 of FIG. 6; and FIG. 8 is a perspective view of an alternative thin shouldered threaded mounting stud which may be used instead of the threaded stud and spring unit assembly.

DETAILED DESCRIPTION OF A PREFERRED EMBODIMENT

Referring to FIGS. 1 through 8 of the drawings, wherein like reference characters designate corresponding parts throughout the several figures, the deck mount speaker assembly of the present invention, indicated in general by the reference character 10, comprises a speaker grille 11 forming the upwardly facing cover panel for the speaker assembly and the basic speaker assembly 12 which in this illustrative embodiment is of a considerably thinner configuration than is available with ordinary deep speaker designs, providing a thin speaker of 1½ inch axial depth.

The basic speaker section 12 includes the metallic speaker basket 13 having an annular outer cup-like rim portion formed by the annular back wall portion **13*a* and connecting forwardly projecting cylindrical flange wall 13*b* in which a resilient rectangular cross-section annular gasket 14 is seated and having four spider legs 13*c* extending radially inwardly from the annular back wall perimeter portion 13*a* to an annular spider suspension ring 13*d* to support the magnet assembly of the speaker. A plurality of circumferentially spaced apertured mounting ears 13e project from the forwardmost edges of the outer cylindrical flange portion 13b, at four locations in the illustrated embodiment, to receive mounting screws for mounting the basket 13** to the inside wall panel or structural surface of the automobile door in which the speaker is to be installed.

To achieve the desired low profile providing an axial depth of no greater than 1½ inches for the speaker assembly, the magnet structure assembly is reduced in size from the usual deep speaker configuration, and includes an annular strontium-cobalt woofer magnet 15, which permits size reduction by about ¼ without loss of gap energy, and includes pole pieces formed by the center pole 16 having a circular plate portion 16a forming the rearmost end plate of the pole assembly of a diameter close to but slightly less than the outer diameter of the annular magnet 15, and having a forwardly projecting smaller diameter cylindrical center pole formation 16b projecting through the center opening of the magnet to a location spaced toward the front of the speaker from the front face of the magnet 15, and surrounded by the annular forward pole piece plate 17 of the same outer diameter as the rearmost end plate portion 16a of the center pole 16 and defining therewith an annular recess in which the annular magnet 15 is seated in engagement with the end plate portions 16a and 17 of the pole pieces. The pole pieces therefore provide maximum flux densities resulting in high efficiency, smooth response. The magnet assembly structure formed of the magnet 15 and pole piece components 16 and 17 are affixed to and carried by the spider suspension ring portion 13d of the basket 13 by known adhesive bonding materials or similar fastening techniques and may, if desired, include a fiber spacer between the inner ring portion 13d of the basket 13 and the pole piece end plate component 17 to prevent magnetic energy from dissipating into the basket.

The woofer cone for this low profile thin speaker instead of being of the traditional pyramid-shaped cone configuration ordinarily used in standard deep speakers, employs a novel forwardly convex curve-shaped woofer cone 19 provided with an undulating or sinuous cross-sectioned hinge portion 19a near its outer rim 19b and the forwardly bowed or convex section shape over the remainder of the cone 19. The outer rim portion 19b of the woofer cone 19 is fixed to the outer rim portion of the basket 13 between the peripheral back wall portion 13a and the gasket 14, as by conventional bonding materials, and the inner annular edge of the woofer cone 19 is joined to and supports the thin voice coil form 20 having the voice coil winding 21 carried thereon located in the air gap between the inner edge of the front end plate pole piece 17 and the adjacent confronting forward-most portions of the cylindrical boss 16b of the center pole 16.

This speaker is designed as a two-way speaker, with the large cone 19 and its voice coil 21 and magnet 15 handling the bass part of the sound in the frequency range from about 100 HZ to 4000 HZ, serving as the woofer, and a second speaker, which is of the conventional dome-horn loaded type, indicated generally by reference character 23 is mounted forwardly spaced from and aligned with the center opening portion of the woofer cone 19, to handle the midrange/tweeter part of the sound spectrum in the range of about 4000 to 17000 HZ. The dome-horn loaded tweeter 23 in the preferred embodiment of the present invention is a conventional one inch dome-horn loaded tweeter, supported in a bridge structure 24 having an annular center opening portion 24a to which the mounting rim portion 23a of the tweeter assembly is secured by rivets or similar fasteners, and includes an outer flange portion 24b which is secured by rivets to the peripheral back wall portion 13a of the basket at diametrically opposite locations.

The spider hinge action of the usual damper or centering device suspension structure of regular speakers that normally keeps the voice coil in a linear pattern during operation could not be relied upon with this shallow speaker. Shallow speakers are vulnerable to voice coil rubbing because the space between the spider suspension and the cone hinge portion is small. Ideally, the cone of a speaker should move as a piston and not sway in its normal in and out motion during sound generating operation. In deep speakers, this kind of movement is obtained more easily than with narrow or shallow designs, since the two bearing points formed by the spider and the cone hinge between which the cone moves are further apart, and the further these bearing points are spaced from each other, the more nearly the piston or cone travels in a straight line. As these two bearing points are brought closer together, as in shallow speakers, there is increased possibility of greater tilting of the piston. To overcome this problem in the speaker of the present invention, the end plate portions 17, 16a of the magnet pole pieces were made as thin as possible and the voice coil depth into the magnet structure was kept small. The gap size was maintained approximately as in other speakers, so that with this arrangement, the cone can be tilted over a range of about 10° without rubbing, thus avoiding the voice coil rubbing problem with this shallow speaker configuration.

The speaker grille or top panel 11 is designed to be normally disposed horizontally against the top surface of a generally horizontal deck formation 26, such as the rear deck forwardly adjacent the rear window, or the top deck portion of the dashboard structure, and the basic speaker section 12 is then fastened to the grille 11 against the undersurface of the automobile deck or the like by a plurality of depending threaded fasteners carried by the speaker grille 11, with the gasket 14 of the basic speaker section 12 pressed tightly against the undersurface of the deck 26 to protect against high temperatures and provide a tight acoustic seal. To this end, the grille 11 in the preferred embodiment is of generally rectangular configuration as illustrated in FIGS. 4 and 5 and is formed of a one-piece unitary plastic molding of generally rectangular outline formed of a rectangular main panel portion 30 in the form of a solid unitary plastic panel having a circular center opening 31 of a diameter corresponding substantially to the inner diameter of the gasket 14 traversed at vertically spaced intervals by horizontal grille bars 32 spanning the entire width of the panel portion 30 and forming rectangular cross-section horizontal ribs which project forwardly beyond the plane of the top surface of the front and rear edge portions 30a,30b of the main panel portion 30.

The bottom surface of the main panel portion 30 of the grille 11 may, if desired, be covered with woven mesh or other conventional speaker cloth, and is provided with four preformed molded holes, as indicated at 34, near the four corners of the main panel portion at the proper locations for the mounting studs, indicated at 35. The mounting studs are simply headless threaded long screws designed to be capable of being threaded into, and form their own threads in, the plastic material in the bounding walls of the holes 34 formed in the plastic material. As indicated, the holes 34 are preferably formed in downwardly projecting circular bosses 36 molded in the plastic material of the grille, for example projecting about 0.165 inch below the bottom surface of the main panel portion 30 and having a diameter of about 0.400 inch. In the illustrated embodiment, the hole 34 has a lower larger diameter cylindrical entrance portion 34*a* having a diameter of about 0.160 inch, joined by an inwardly tapering transition section which joins a smaller diameter middle section 34*b* having a diameter, for example, of about 0.144 inch, and which then joins an inwardly tapering frustoconical root section 34*c* converging to a smaller diameter of 0.120 inch, and the lower 0.100 inch portion of the hole is intersected by a diametric slit formation 37 in the boss 36, for example about 0.020 inches wide and about 0.300 inches long. This hole 34 in the boss formation 36 is designed to permit the headless threaded long screw or stud 35 to be initially screwed by hand, and then tightened by pliers, to seat the mounting screws or studs 35 into the holes 34, after which a standard rectangular flat type single thread spring nut of the type known as a "Tinnerman nut", as indicated at 38, made of sheet metal and punched to provide a screw hole with edges of the two jaw forming bent tabs engaging the threads of the mounting stud or screw 35 and threaded onto the stud to abut the lower face of the associated boss 36. The holes 34 in the grille itself are so shaped that one can thread the mounting stud or headless screw 35 into the respective hole 34 easily, but this would not be secure enough to reliably hold the speaker. However, by using the threaded long screw or mounting stud 35 with no head, inserted one or two turns into the plastic material of the hole 34, and using the flat type punched spring nut or Tinnerman nut threaded onto the stud, the Tinnerman nut is capable of supporting the speaker by bearing downwardly against the top face of the rear deck 36 or other supporting panel.

The mounting studs 35 extend through the holes 26*a* in the rear deck, and through recesses in the gasket 14 for receiving the mounting studs, if needed in installations not having the projecting ears 13*e*, and through the holes in the speaker basket, as in the formations 13*e*, and conventional nuts, such as speed nuts 39, are then applied from beneath to the mounting studs 35 and run up against the speaker basket to support the speaker in position.

Therefore, the speaker assembly can be readily installed by the customer simply screwing the threaded mounting studs or headless screws 35 into the holes 34 of the main panel portion of the grille 11, first by using finger pressure and then by tightening a few turns with ordinary pliers. Then the flat spring nut or Tinnerman type nut 38 is screwed up as far as it can go on each of the mounting studs 35 until they abut the lower faces of the bosses 36, and the grille with the four installed mounting studs or screws 35 as positioned over the speaker opening either preformed or cut by the customer in the deck 26 of the automobile on which the speaker is to be mounted with the mounting studs 35 inserted through approximately 3/16 inch holes therefor in the deck 26 surrounding the speaker opening. With the grille thus supported in place overlying the speaker opening in the deck 26, the speaker is positioned from underneath the deck to extend the mounting studs 35 through the holes therefor in the speaker basket, and the speed nuts 39 are then tightened onto the mounting studs 35 from beneath until they butt against the speaker basket portions surrounding the holes in the speaker basket for the mounting nuts, while the gasket 14 is tightly abuutting the undersurface of the deck. With this arrangement, the weight of the speaker is thus supported by the flat spring nuts 38 and not the grille, which is in contrast to the brass insert prior art arrangement where the speaker weight is supported by the brass insert. Additionally, the significant cost associated with the use of the brass studs, which are expensive because they are a screw machine product, and which must be inserted by costly labor operations such as by sonic welding techniques or by prepositioning them in the mold, is avoided by the arrangement herein described.

Alternatively, instead of using the threaded mounting studs 35 and flat spring nuts 38, a specially formed thin shouldered threaded mounting screw or stud, illustrated in FIG. 8 and indicated by the reference character 45, may be used. In this case, the shouldered mounting stud 45 may be about 64 mm long, and have 8–32 threads, provided in a first lower zone 46 over the major portion of the length thereof and over a short upper end portion 47. A thin shoulder flange formation 48 is provided at the lower end of the threaded upper portion 47, having, for example, a thickness of about 0.75 mm and a diameter of about 10 mm with two diametrically opposite flats along parallel chords of a circle spaced symmetrically about 7 mm apart. With this shouldered mounting stud 45, the stud end portions 47 are screwed into the holes or sockets 34 of the grille main panel portion until the shoulders 48 butt against the faces of the bosses 36, and the grille with assembled mounting studs 45 is then installed on the deck 26 in the same manner described for the preceding embodiment.

I claim:

1. A deck mount type speaker assembly for installation on a generally horizontal automobile deck and the like with the speaker assembly facing upwardly on the automobile deck, comprising a main speaker section including a speaker basket frame having an outer generally annular rim portion to be supported from the deck and having mounting holes for receiving fasteners to fix the main speaker section against the underside of the automobile deck, the main speaker section including a woofer speaker unit comprising a speaker magnet and pole structure supported rigidly from the basket frame and a deformable woofer cone peripherally supported from said rim portion, a grille panel of unitary plastic material to be disposed in overlying abutment on the automobile deck including a generally flat panel portion having a plurality of sound transmitting openings therethrough disposed in an array forming an interrupted sound passage having a diameter similar to the inner diameter of the woofer cone, said panel portion having a plurality of unthreaded downwardly facing sockets molded therein whose plastic walls are deformable by threads of mounting screws to be inserted therein, a plurality of long headless threaded mounting screws respectively threaded into said sockets in a manner forming their own self-tapped mating threads in the plastic walls of said sockets to extend downwardly through the deck and said mounting holes for receiving nuts threaded thereon to retain the grille and speaker section assembled together and provide underlying abutting support for the basket frame from said mounting screws, and means on said mounting screws providing a flat flange-like shoulder on each of said screws and located a short distance below the upper ends of said screws in abutment against said grille between the grille and said deck to transfer the weight load of the speaker section on said screws to said deck and relieve the grille of such speaker weight load.

2. A deck mounted type speaker assembly as defined in claim 1, wherein said headless mounting screws are at least partially inserted in threaded relation in said sockets by finger pressure application of turning torque thereto, the plastic grille material of the socket walls being sufficiently deformable to produce some thread coupling with the threads of said screws responsive to such finger pressure torque.

3. A deck mount type speaker assembly as defined in claim 2, wherein further threads are deformed in said socket walls by the mounting screw threads by application of pliers applied turning torque to the screws after application of the finger pressure torque.

4. A deck mount type speaker assembly as defined in claim 1, wherein said flange-like shoulder is formed by a flat type spring nut threaded on its associated mounting screw.

5. A deck mount type speaker assembly as defined in claim 4, wherein said spring nut is a downwardly concave spring nut having peripheral edge portions to bear downwardly against top surface portions of the deck and having screw-engaging single thread jaw segments for normally gripping the mounting screw at locations spaced slightly above the deck top surface.

6. A deck mount type speaker assembly as defined in claim 4, wherein said spring nut is a downwardly concave bowed rectangular spring nut having opposite peripheral edge portions to bear downwardly against top surface portions of the deck and having screw-engaging single thread jaw segments for normally gripping the mounting screw at locations spaced slightly above the deck top surface.

7. A deck mount type speaker assembly as defined in claim 4, wherein said headless mounting screws are at least partially inserted in threaded relation in said sockets by finger pressure application of turning torque thereto, the plastic grille material of the socket walls being sufficiently deformable to produce some thread coupling with the threads of said screws responsive to such finger pressure torque.

8. A deck mount type speaker assembly as defined in claim 7, wherein further threads are deformed in said socket walls by the mounting screw threads by application of pliers applied turning torque to the screws after application of the finger pressure torque.

9. A deck mount type speaker assembly as defined in claim 8, wherein said spring nut is a downwardly concave spring nut having peripheral edge portions to bear downwardly against top surface portions of the deck and having screw-engaging single thread jaw segments for normally gripping the mounting screw at locations spaced slightly above the deck top surface.

10. A deck mount type speaker assembly as defined in claim 8, wherein said spring nut is a downwardly concave bowed rectangular spring nut having opposite peripheral edge portions to bear downwardly against top surface portions of the deck and having screw-engaging single thread jaw segments for normally gripping the mounting screw at locations spaced slightly above the deck top surface.

11. A deck mount type multirange speaker assembly for installation on a generally horizontal automobile deck and the like with the speaker assembly facing upwardly on the automobile deck, comprising a main speaker section including a speaker basket frame having an outer generally annular rim portion to be supported from the deck and having mounting holes for receiving fasteners to fix the main speaker section against the underside of the automobile deck, the main speaker section including a woofer speaker unit comprising a speaker magnet and pole structure supported rigidly from the basket frame and a deformable woofer cone peripherally supported from said rim portion and carrier structure supported by said rim portion having a higher-frequency-range second speaker unit carried thereby, a grille panel of unitary plastic material to be disposed in overlying abutment on the automobile deck including a generally flat panel portion having a plurality of sound transmitting openings therethrough disposed in an array forming an interrupted sound passage having a diameter similar to the inner diameter of the woofer cone, said panel portion having a plurality of unthreaded downwardly facing sockets molded therein whose plastic walls are deformable by threads of mounting screws to be inserted therein, a plurality of long headless threaded mounting screws respectively threaded into said sockets in a manner forming their own self-tapped mating threads in the plastic walls of said sockets to extend downwardly through the deck and said mounting holes for receiving nuts threaded thereon to retain the grille and speaker section assembled together and provide underlying abutting support for the basket frame from said mounting screws, and means on said mounting screws providing a flat flange-like shoulder on each of said screws and located a short distance below the upper ends of said screws in abutment against said grille between the grille and said deck to transfer the weight load of the speaker section on said screws to said deck and relieve the grille of such speaker weight load.

12. A deck mount type speaker assembly as defined in claim 11, wherein said headless mounting screws are at least partially inserted in threaded relation in said sockets by finger pressure application of turning torque thereto, the plastic grille material of the socket walls being sufficiently deformable to produce some thread coupling with the threads of said screws responsive to such finger pressure torque.

13. A deck mount type speaker assembly as defined in claim 12, wherein further threads are deformed in said socket walls by the mounting screw threads by application of pliers applied turning torque to the screws after application of the finger pressure torque.

14. A deck mount type speaker assembly as defined in claim 11, wherein said flange-like shoulder is formed by a downwardly concave bowed rectangular spring nut threaded on its respective mounting screw having opposite peripheral edge portions to bear downwardly against top surface portions of the deck and having screw-engaging single thread jaw segments for normally gripping the mounting screw at locations spaced slightly above the deck top surface.

* * * * *